US006536915B1

(12) United States Patent
Chang

(10) Patent No.: US 6,536,915 B1
(45) Date of Patent: Mar. 25, 2003

(54) LAMP STRING

(76) Inventor: Ming-Cheng Chang, No. 10, Alley 48, Lane 5, Sheng Li Street, Yung Kang, Tainan Hsien (TW)

( * ) Notice: Subject to any disclaimer, the term of this patent is extended or adjusted under 35 U.S.C. 154(b) by 0 days.

(21) Appl. No.: 10/072,928

(22) Filed: Feb. 12, 2002

(51) Int. Cl.[7] ..... F21V 5/00

(52) U.S. Cl. ..... 362/246; 362/237; 362/236; 362/227

(58) Field of Search ..... 362/227, 235, 362/236, 237, 244, 246

(56) References Cited

U.S. PATENT DOCUMENTS 4,271,458 A * 6/1981 George, Jr. ..... 362/236
4,984,142 A * 1/1991 Garnerone ..... 362/249
6,135,612 A * 10/2000 Clore ..... 362/184
6,283,612 B1 * 9/2001 Hunter ..... 362/240

* cited by examiner

*Primary Examiner*—Laura K. Tso
(74) *Attorney, Agent, or Firm*—Rosenberg, Klein & Lee

(57) ABSTRACT

A lamp string comprises a plurality of serially connected lamp units. Each lamp unit comprises a casing, two base plates respectively mounted in two ends of the casing, an illuminating member mounted in the casing, at least one metallic bar extending between the base plates and electrically connected to the illuminating member, and two end covers removably attached to the ends of the casing for closing the casing. Two adjacent ones of the lamp units are electrically connected by at least one wire that is electrically connected to the illuminating member and the metallic bar. A soft tube may be provided to enclose the wire.

6 Claims, 4 Drawing Sheets

LAMP STRING

BACKGROUND OF THE INVENTION

1. Field of the Invention

The present invention relates to a lamp string that allows easy replacement of damaged lamps.

2. Description of the Related Art

FIG. 6 of the drawings illustrates a conventional lamp string comprising a plurality of lamps 42 electrically connected in series by wires 43. The lamps 42 and the wires 43 are enclosed in a soft tube 41, and an enveloping layer 44 covers the soft tube 41 to protect the wires 43 and the lamps 42 from weather. Namely, the wires 43 and the lamps 42 are thus protected from sunlight and rain. The lamp string can be bent to any desired figure or pattern, and an external controller may be provided to control lighting of the lamps. However, the diameter of the soft tube 41 must be increased in response to an increase in the size of he lamps 42. In this case, the lamps 42 would be damaged during bending of the soft tube 41 if the thickness of the soft tube 41 remains the same. If the thickness of the soft tube 41 is increased for protecting the lamps 42, the softness of the soft tube 41 decreases, and the bending effect is reduced. In some cases, it would be difficult or impossible to obtain the required figure or pattern of the bent soft tube 41. Further, the wires 43 surrounding the lamps 42 bar the illumination effect of the lamps 42. Further, replacement of damaged lamps 42 enveloped by the enveloping layer 44 is impossible. As a result, the user has to buy a new lamp string just because of damage of few lamps 42.

SUMMARY OF THE INVENTION

An object of the present invention is to provide a lamp string that allows easy replacement of damaged lamps.

A lamp string in accordance with the present invention comprises a plurality of serially connected lamp units. Each lamp unit comprises a casing, two base plates respectively mounted in two ends of the casing, an illuminating member mounted in the casing, at least one metallic bar extending between the base plates and electrically connected to the illuminating member, and two end covers removably attached to the ends of the casing for closing the casing. Two adjacent ones of the lamp units are electrically connected by at least one wire that is electrically connected to the illuminating member and the metallic bar. A soft tube may be provided to enclose the wire.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
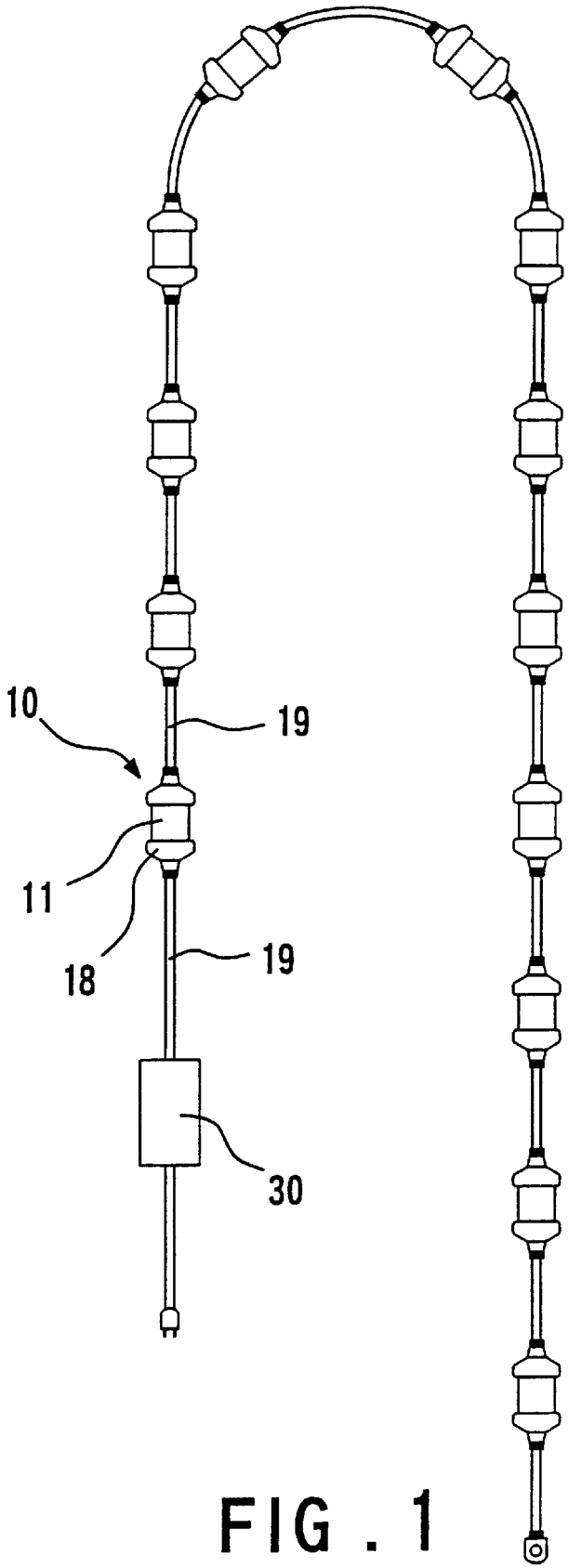
FIG. 1 is a side view of a lamp string in accordance with the present invention.
Figure 4:
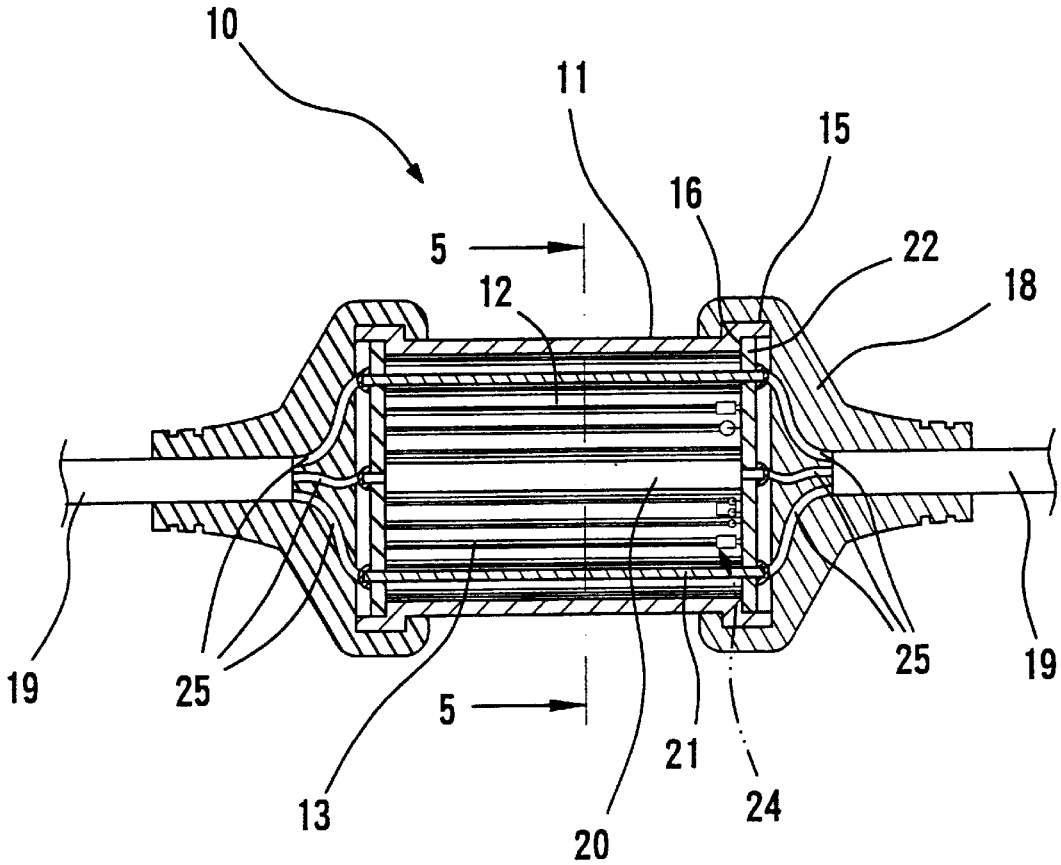
FIG. 4 is a sectional view taken along plane 4—4 in FIG. 3.
Figure 5:
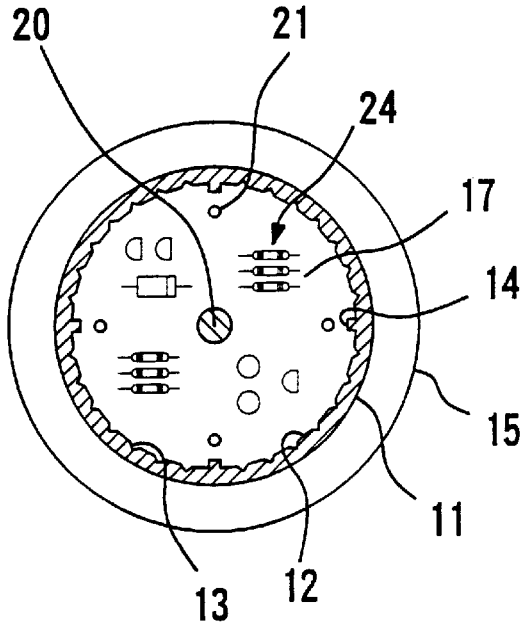
FIG. 5 is a sectional view taken along plane 5—5 in FIG. 4.
Figure 6:
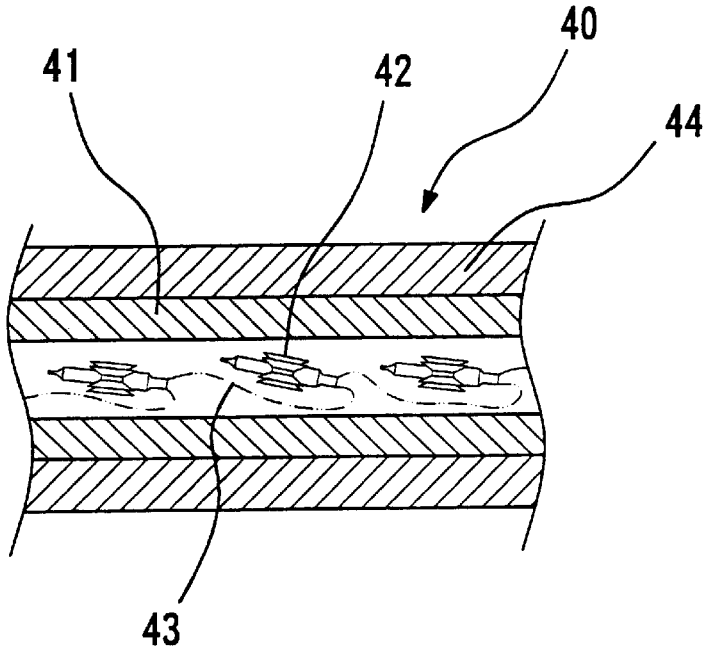
FIG. 6 PRIOR ART
FIG. 6 is a sectional view of a conventional lamp string.

Referring to FIG. 1, a lamp string in accordance with the present invention generally comprises a plurality of lamp units 10 serially connected by wires 25 (FIG. 4). A controller 30 is connected to the lamp string for controlling lighting of the lamp units 10.

Figure 2:
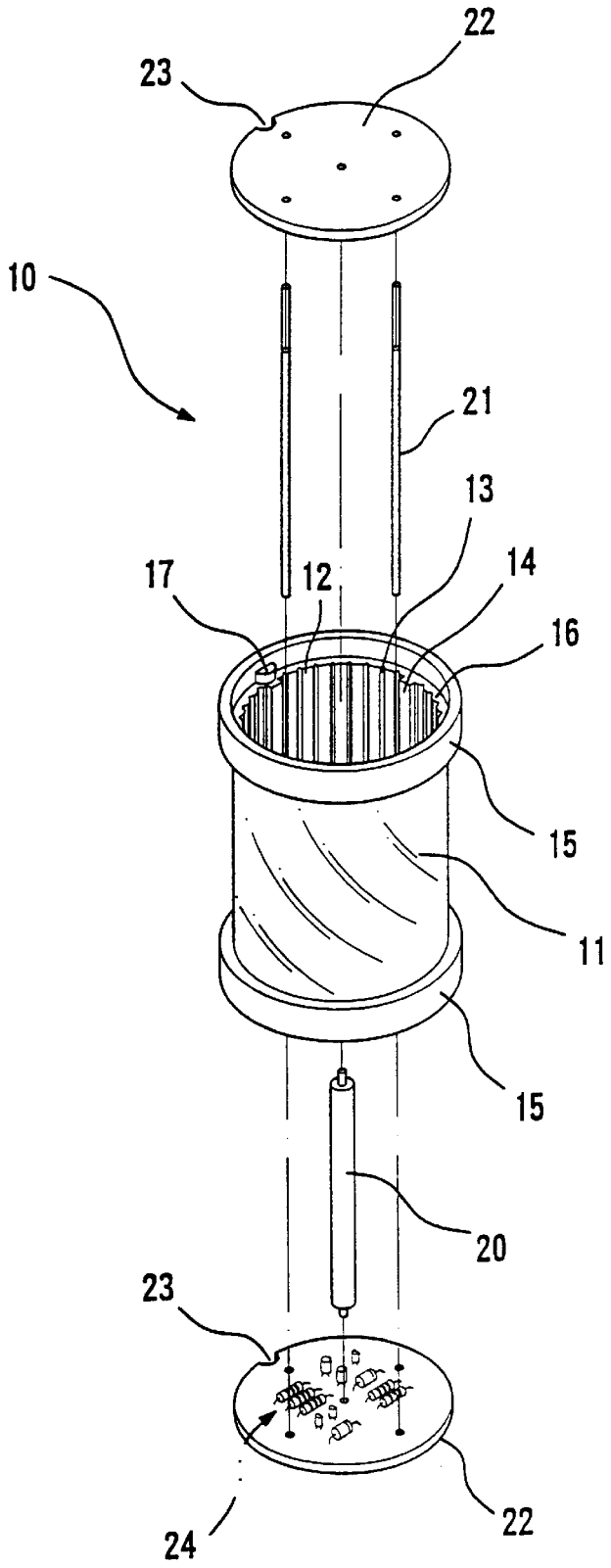
FIG. 2 is an exploded perspective view of a lamp unit of the lamp string in accordance with the present invention.
Figure 3:
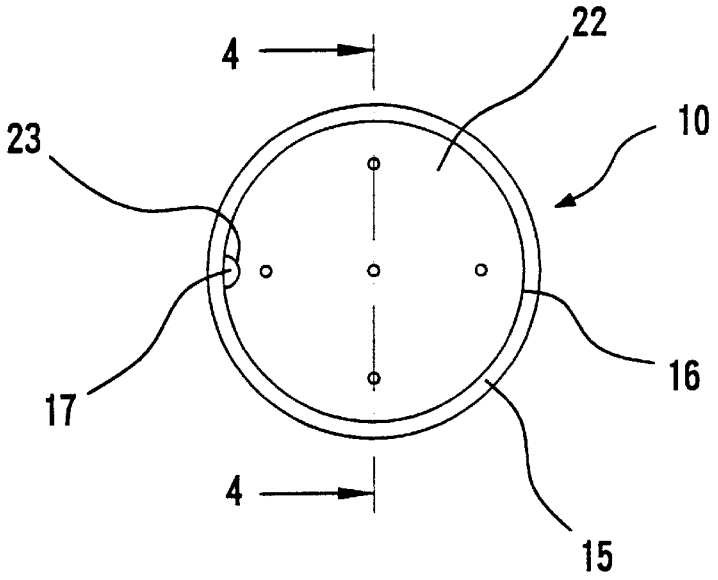
FIG. 3 is an end view of the lamp unit in accordance with the present invention.

As illustrated in FIGS. 1 through 3, each lamp unit 10 includes a casing 10 and two end covers 18 attached to two ends of the casing 10. A plurality of longitudinal grooves 13 and longitudinal ribs 14 are alternately disposed on an inner periphery 12 of the casing 10. Each end of the casing 10 includes a flange 15. Each flange 15 and an associated end of the casing 10 together define an annular positioning groove 16 for receiving a base plate 22. A protrusion 17 is provided in each positioning groove 16 for engaging with a notch 23 in an associated base plate 22, thereby retaining the base plate 22 in place without the risk of rotation. An illuminating member 20 is mounted in the casing 10 and between the base plates 21. Plural metallic bars 21 extend between the base plates 21 and electrically connected to electric elements 24 on the base plates 21. The illuminating member 20 is also electrically connected to the electric elements 24 for controlling the lighting effect.

Referring to FIGS. 2 and 4, after assembly of the lamp unit 10, the end covers 18 are attached to the flanges 15 of the lamp unit 10. At least one wire 25 is attached to each end cover 18 and electrically connected to the metallic bars 21 and the illuminating member 20. The wire 25 is enveloped by a soft tube 19 and thus allows the lamp string to be bent to any desired figure or pattern. Since the base plates 22 are attached to two ends of the casing 11 and since the electric elements 24 are mounted to the base plate 22 and thus do not interfere with lighting of the illuminating member 20, the light rays emitted by the illuminating member 20 are not obstructed; namely, a 360° illumination effect is obtained. Further, the elements in the casing 11 are closed by the end covers 18. A waterproof effect is obtained. Further, the emitted light rays are refracted by the longitudinal grooves 13 and longitudinal ribs 14 disposed on the inner periphery 12 of the casing 10 to enhance the uniform 360° illumination effect. Further, the metallic bars 21 provide an additional support function to prevent damage to the illuminating member 20 during bending of the soft tube 19. The casing 11 is rigid to protect the illuminating member 20, and the ribs 14 reinforce the strength of the casing 11. The size of the illuminating member 20 can be varied, as a sufficiently large compartment is provided by the casing 11 for receiving the illuminating member 20 of different sizes. In a case that a lamp unit 10 is damaged, the user may remove it from the lamp string and replace with a new one without the need of buying a new lamp string.

Although the invention has been explained in relation to its preferred embodiment, it is to be understood that many other possible modifications and variations can be made without departing from the scope of the invention as hereinafter claimed.

What is claimed is:

1. A lamp string comprising a plurality of serially connected lamp units, each said lamp unit comprising:

a casing having two ends;

two base plates respectively mounted in said ends of said casing;

an illuminating member mounted in said casing;

at least one metallic bar extending between said base plates and electrically connected to said illuminating member; and two end covers removably attached to the ends of the casing for closing the casing;

two adjacent ones of said plurality of lamp units being electrically connected by at least one wire that is electrically connected to said illuminating member and said at least one metallic bar.

2. The lamp string as claimed in claim 1, wherein said casing includes a plurality of longitudinal grooves and longitudinal ribs on an inner periphery thereof.

3. The lamp string as claimed in claim 1, wherein each said base plate includes a plurality of electric elements mounted thereon, said illuminating member and said at least one metallic bar being electrically connected to said electric elements on said base plates.

4. The lamp string as claimed in claim 1, wherein each said end of said casing includes a flange to which an associated one of the end covers is attached, each said flange and an associated one of the ends of said casing together defining a positioning groove for receiving an associated one of said base plates.

5. The lamp string as claimed in claim 4, wherein each said base plate includes a notch, a protrusion being formed in each said positioning groove for engaging with the notch of the associated base plate, thereby retaining said base plate in place.

6. The lamp string as claimed in claim 1, further comprising a soft tube for enclosing said at least one wire.

* * * * *